US005465532A

United States Patent [19]

Varin

[11] Patent Number: 5,465,532

[45] Date of Patent: Nov. 14, 1995

[54] LOWER EDGE DOOR SEAL

[76] Inventor: Robert Varin, P.O. Box 418232, Sacramento, Calif. 95841-8232

[21] Appl. No.: 302,218

[22] Filed: Sep. 8, 1994

[51] Int. Cl.[6] ..... E06B 7/16

[52] U.S. Cl. ..... 49/493.1; 49/58; 49/470

[58] Field of Search ..... 49/493.1, 470, 49/490.1, 58, 60, 309, 306

[56] References Cited

U.S. PATENT DOCUMENTS

| | | | |
|---|---|---|---|
| 2,428,731 | 10/1947 | Abrams | 49/493.1 X |
| 3,512,303 | 5/1970 | Wright | 49/309 |
| 3,854,246 | 12/1974 | McAllister | 49/470 |
| 4,765,094 | 8/1988 | Gemmell | 49/493.1 X |
| 5,214,880 | 6/1993 | Woodruff et al. | 49/493.1 X |

FOREIGN PATENT DOCUMENTS

| | | | |
|---|---|---|---|
| 733922 | 12/1965 | Canada | 49/470 |

*Primary Examiner*—Philip C. Kannan

[57] ABSTRACT

A seal for precluding an entrance of rodents or debris underneath a door. The inventive device includes a mounting assembly securable to a lower edge of a door, such as a security door or the like. A flexible seal is supported by the mounting means so as to extend downwardly from the lower edge of the door to contact a ground surface therebeneath. The flexible seal projects laterally of the mounting assembly so as to additionally contact adjacent lateral surfaces of the associated structure. The device allows an entrance door of the structure to be left open with only the security door closed to permit a passage of air currents through the security door while simultaneously precluding an entrance of rodents or debris underneath the security door.

7 Claims, 3 Drawing Sheets

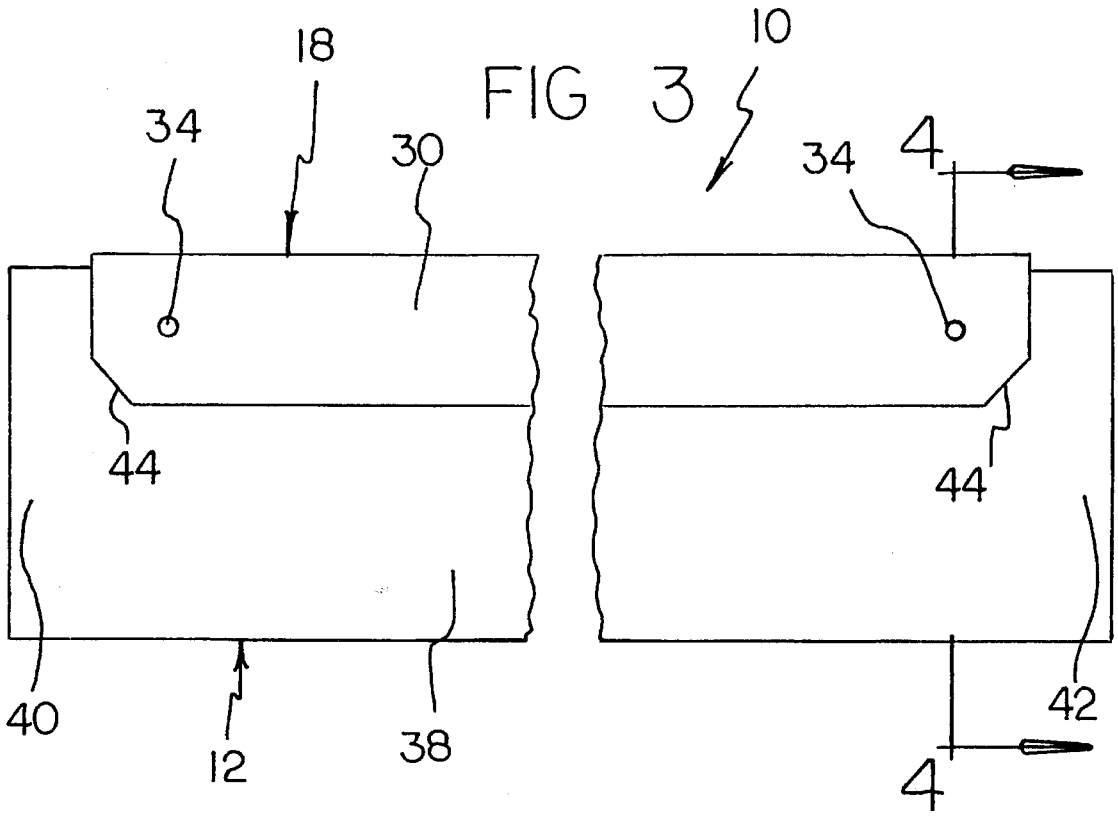
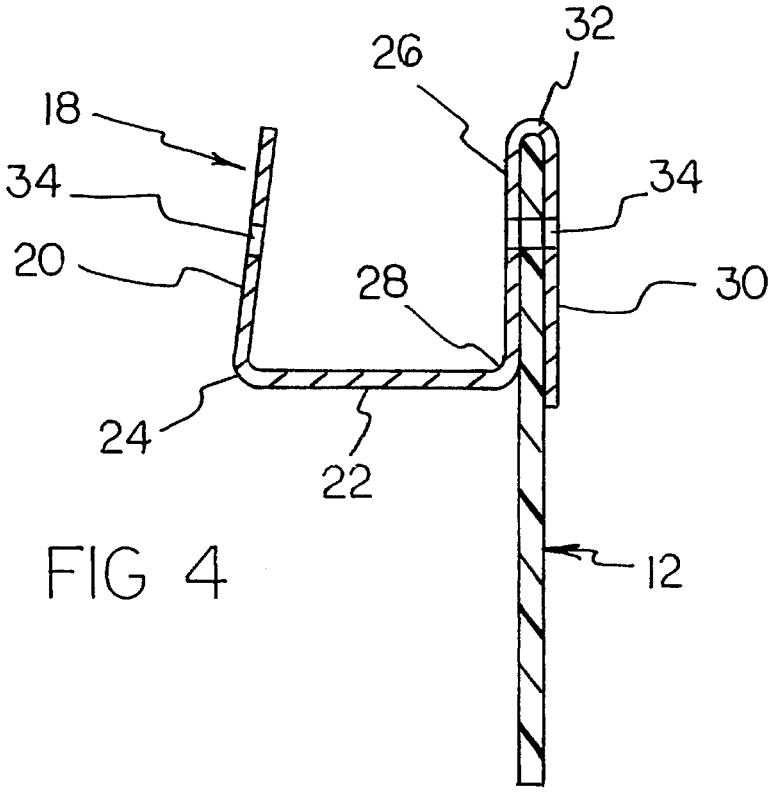
FIG 4

LOWER EDGE DOOR SEAL

BACKGROUND OF THE INVENTION

1. Field of the Invention

The present invention relates to sealing structures and more particularly pertains to a seal for precluding an entrance of rodents or debris underneath a door.

2. Description of the Prior Art

It is desirable in some areas to have both an entrance door as well as a security door dosing the entrance to an associated structure. Typically, the entrance door of such organization is solid and can be securely locked shut to preclude an entrance into the structure. While the security door is typically configured to also be securely locked, most security doors are constructed to permit a passage of air currents therethrough. Conventionally known security doors are not sealed about a perimeter thereof and therefore permit rodents or debris to pass underneath. Thus, when the entrance door in an open position, such rodents and debris are free to pass underneath the door and into the associated structure.

Therefore, it can be appreciated that there exists a continuing need for a new lower edge door seal which can be utilized for precluding an entrance of rodents or debris underneath a door. In this regard, the present invention substantially fulfills this need.

SUMMARY OF THE INVENTION

In view of the foregoing disadvantages inherent in the known types of sealing structures now present in the prior art, the present invention provides a new lower edge door seal construction wherein the same can be utilized for precluding an entrance of rodents or debris underneath a door. As such, the general purpose of the present invention, which will be described subsequently in greater detail, is to provide a new lower edge door seal apparatus and method which has many of the advantages of the sealing structures mentioned heretofore and many novel features that result in a lower edge door seal which is not anticipated, rendered obvious, suggested, or even implied by any of the prior art sealing structures, either alone or in any combination thereof.

To attain this, the present invention generally comprises a seal for precluding an entrance of rodents or debris underneath a door. The inventive device includes a mounting assembly securable to a lower edge of a door, such as a security door or the like. A flexible seal is supported by the mounting means so as to extend downwardly from the lower edge of the door to contact a ground surface therebeneath. The flexible seal projects laterally of the mounting assembly so as to additionally contact adjacent lateral surfaces of the associated structure. The device allows an entrance door of the structure to be left open With only the security door closed to permit a passage of air currents through the security door while simultaneously precluding an entrance of rodents or debris underneath the security door.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and, systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new lower edge door seal apparatus and method which has many of the advantages of the sealing structures mentioned heretofore and many novel features that result in a lower edge door seal which is not anticipated, rendered obvious, suggested, or even implied by any of the prior art sealing structures, either alone or in any combination thereof.

It is another object of the present invention to provide a new lower edge door seal which may be easily and efficiently manufactured and marketed.

It is a further object of the present invention to provide a new lower edge door seal which is of a durable and reliable construction.

An even further object of the present invention is to provide a new lower edge door seal which is susceptible of a low cost of manufacture with regard to both materials and labor, and which accordingly is then susceptible of low prices of sale to the consuming public, thereby making such lower edge door seals economically available to the buying public.

Still yet another object of the present invention is to provide a new lower edge door seal which provides in the apparatuses and methods of the prior art some of the advantages thereof, while simultaneously overcoming some of the disadvantages normally associated therewith.

Still another object of the present invention is to provide a new lower edge door seal for precluding an entrance of rodents or debris underneath a door.

Yet another object of the present invention is to provide a new lower edge door seal which includes a mounting assembly securable to a lower edge of a door, and a flexible seal supported by the mounting means so as to extend downwardly from the lower edge of the door to contact a ground surface therebeneath, with the flexible seal projecting laterally of the mounting assembly so as to additionally contact adjacent lateral surfaces of the associated structure such that an entrance door of the associated structure can be opened with only the security door being closed to permit a passage of air currents through the security door while simultaneously precluding an entrance of rodents or debris underneath the security door.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front elevation of the invention, per se.

FIG. 4 is a cross sectional view taken along line 4—4 of FIG. 3.

DESCRIPTION OF THE PREFERRED EMBODIMENT

Figure 1:
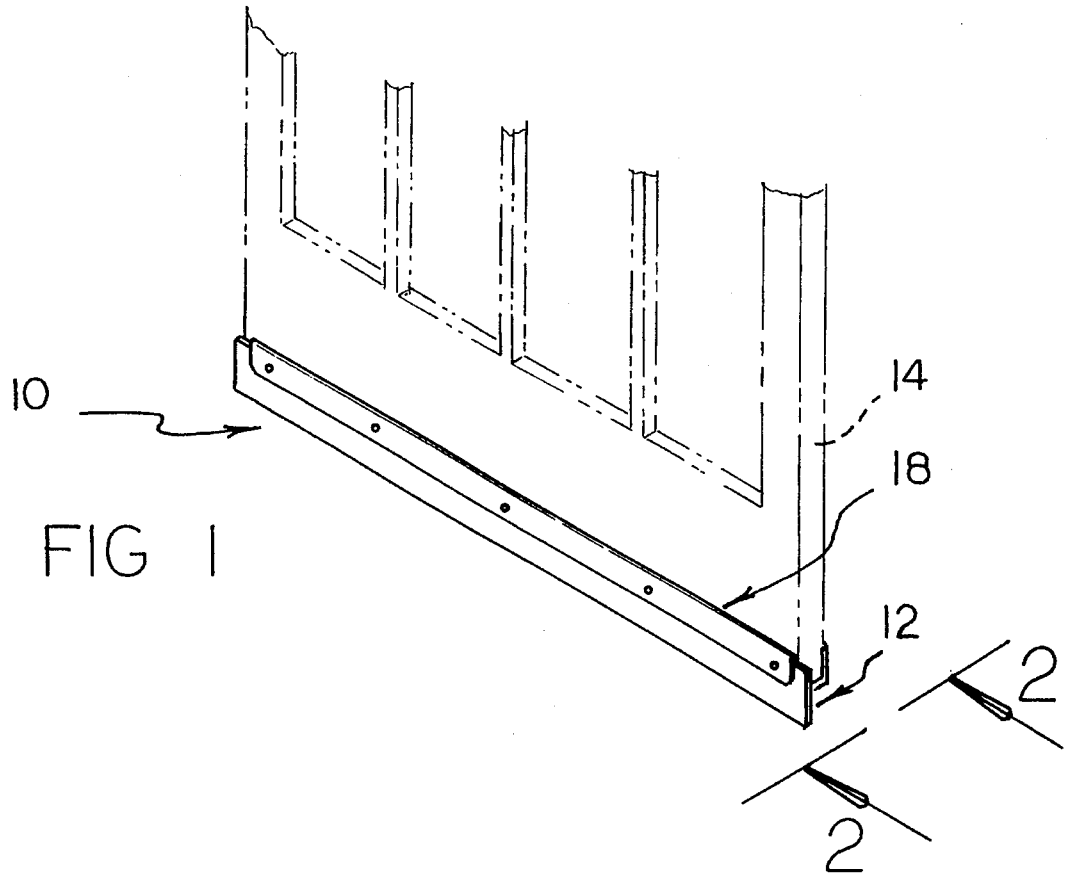
FIG. 1 is an isometric illustration of a lower edge door seal according to the present invention as installed to a door.

With reference now to the drawings, and in particular to FIGS. 1–5 thereof, a new lower edge door seal embodying the principles and concepts of the present invention and generally designated by the reference numeral 10 will be described.

More specifically, it will be noted that the lower edge door seal comprises a flexible seal means 12 for sealing a space between a lower edge of a security door 14 and an underlying ground surface, and a mounting means 18 for securing the flexible seal means to the lower edge of the security door 14, whereby rodents and debris are precluded from passing beneath the security door.

Figure 2:
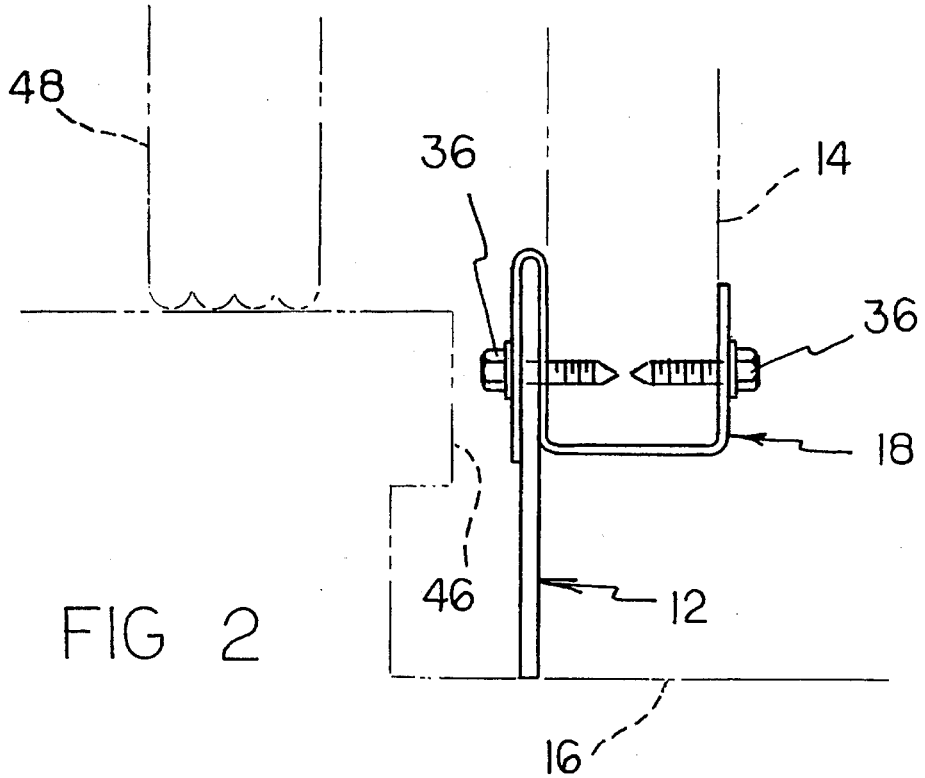
FIG. 2 is a side elevation of the present invention.
Figure 5:
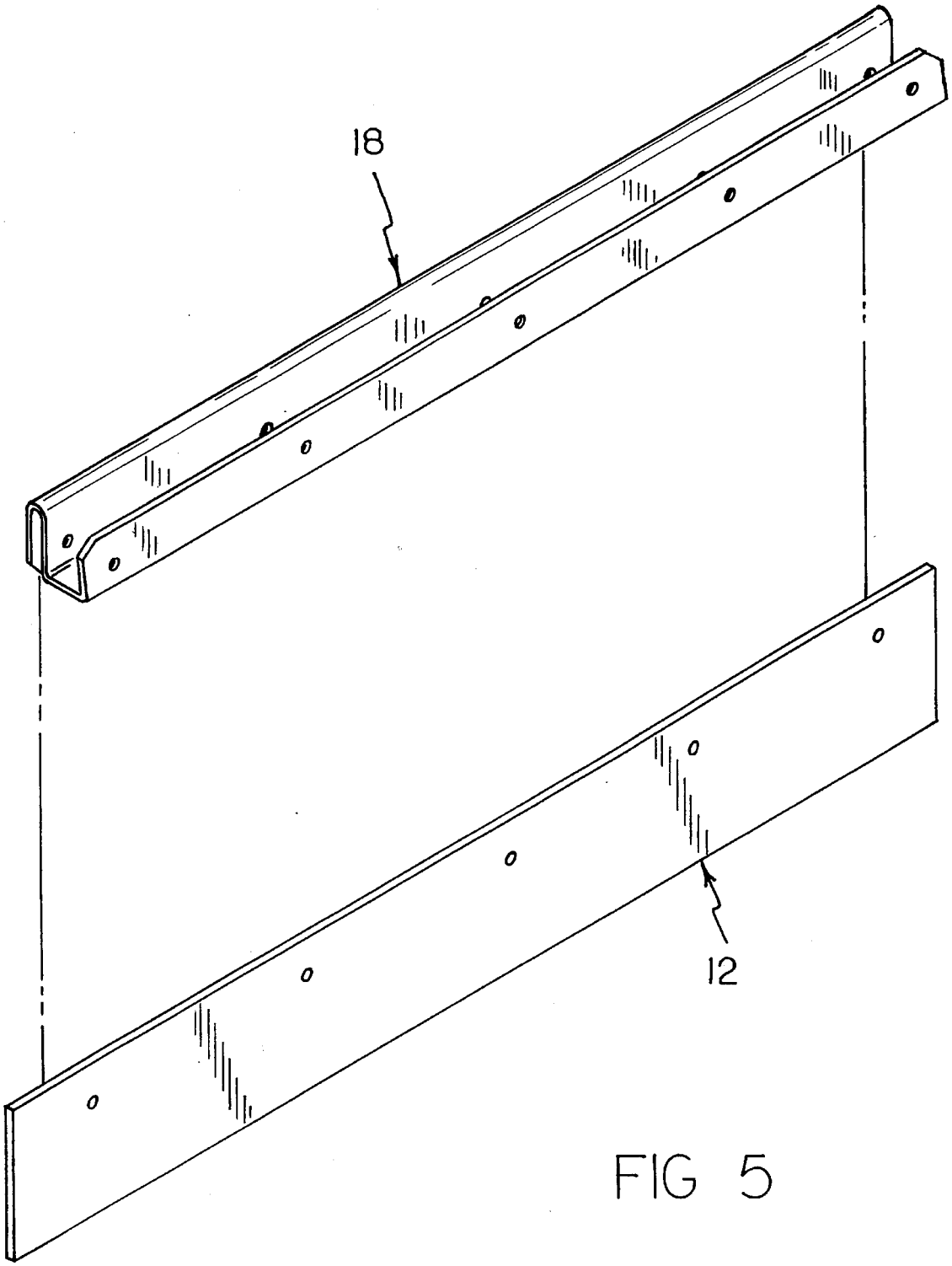
FIG. 5 is an exploded isometric illustration of the present invention.

As best illustrated in FIGS. 2 through 4, the mounting means 18 of the present invention 10 is configured to envelope the unlabeled lower edge of the security door 14. To this end, the mounting means 18 comprises an exterior plate 20 positionable against a lower exterior portion of the security door 14. A lower edge plate 22 positionable into an abutting relationship with a bottom lower edge of the security door is resiliently coupled at an exterior edge thereof to a lower edge of the exterior plate 20 by a first integral bend 24 so as to extend beneath the security door. An interior plate 26 positionable against a lower interior portion of the security door 14 is resiliently coupled at a lower edge thereof to an interior edge of the lower edge plate 22 by a second integral bend 28 so as to extend upwardly therefrom. A securing plate 30 is coupled to an upper edge of the interior plate 26 by a third integral bend 32 and extends substantially parallel to and coextensive with the interior plate. By this structure, the mounting means can receive the lower edge of the security door 14 between the exterior plate 20 and the interior plate 26 to position the lower edge plate 22 into an abutting relationship with the lower edge of the security door. Similarly, the flexible seal means 12 can be received between the interior plate 26 and the securing plate 30, whereby the flexible seal means will be supported so as to depend downwardly from the security door to contact the ground surface 16 therebeneath, as shown in FIG. 2.

The mounting means is preferably constructed such that the exterior plate 20 projects from the lower edge plate 22 at an acute angle relative thereto, whereby the resilient nature of the first integral bend 24 and the second integral bend 28 will permit the lower edge of the security door 14 to be clamped and frictionally retained between the exterior plate and the interior plate of the mounting means 18. Similarly, the securing plate 30 preferably extends slightly towards the interior plate 26, whereby the resilient nature of the third integral bend 32 permits a clamping of the flexible seal means 12 between the securing plate and the interior plate to frictionally retain the flexible seal means relative to the mounting means 18 and the associated security door 14.

To further enhance securement of the device 10 to the associated security door 14, the present invention preferably includes a plurality of mounting apertures 34 directed through the exterior plate 20, the interior plate 26, the securing plate 30, and the flexible seal means 12 to permit the direction of threaded fasteners 36 or the like through both the mounting means and the flexible seal means to threadably engage the lower portions of the security door 14, as shown in FIG. 2. Preferably, separate threaded fasteners 36 are extended from both exterior and interior directions into threaded engagement with the security door 14. However, it is within the intent and purview of the present invention to direct a single threaded fastener through both the mounting means 18 and the flexible seal means 12, whereby the mounting apertures 34 would be accordingly cooperatively aligned.

Referring to FIG. 3 wherein the flexible seal means 12 is illustrated in detail, it can be shown that the flexible seal means comprises an elongated flexible web 38 having a transverse height dimension greater than a transverse height dimension of the interior plate 26 so as to extend beneath the security door 14 when so installed. Further, the elongated flexible web 38 is of a longitudinal length greater than a longitudinal length of the security plate 30 so as to define a first lateral web 40 projecting beyond a first lateral edge of the exterior plate, and a second lateral web 42 projecting beyond a second lateral edge of the security plate. The lateral webs 40, 42 are operable to engage lateral portions of an unillustrated door frame or wall of the associated structure to preclude passage of rodents or debris around lower lateral portions of the security door 14. In this connection, the security plate is preferably provided with oppositely positioned beveled corners 44 which permit a resilient flexing of the lateral webs 40, 42 relative to the mounting means 18 without piercingly engaging the lateral webs as would occur with undesirable orthogonal corners.

In use, the lower edge door seal 10 according to the present invention can be easily installed along a lower edge of a security door 14 or the like. The elongated flexible web 38, as well as the lateral webs 40 and 42, can be cut or trimmed to depend or extend a desired distance so as to lightly contact the adjacent structure. Thus, water, rodents, and other debris will be precluded from passage across the security door from both beneath and around the lower lateral edges of the security door. As shown in FIG. 2, the device 10 is preferably positioned so as to extend between the security door 14 and an adjacent threshold 46, whereby normal operation of the proximal entrance door 48 is not hindered.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lower edge door seal comprising:

a flexible seal means for sealing both a space between a lower edge of a door and an underlying ground surface, and a space between a lateral edge of said door and adjacent lateral structure; and, a mounting means for securing said flexible seal means to a bottom lower edge of said door, wherein said mounting means comprises an exterior plate positionable against a lower exterior portion of said door; a lower edge plate positionable into an abutting relationship with said bottom lower edge of said door resiliently coupled at an exterior edge thereof to a lower edge of said exterior plate; an interior plate positionable against a lower interior portion of said door resiliently coupled at a lower edge thereof to an interior edge of said lower edge plate; a securing plate coupled to an upper edge of said interior plate and extending substantially parallel to and coextensive with said interior plate, wherein said mounting means can receive said lower edge of said door between said exterior plate and said interior plate to position said lower edge plate into an abutting relationship with said bottom lower edge of said door, with said flexible seal means being received between said interior plate and said securing plate.

2. The lower door edge seal of claim 1, wherein said exterior plate projects from said lower edge plate at an acute angle relative thereto, whereby said bottom lower edge of said door can be clamped and frictionally retained between said exterior plate and said interior plate of said mounting means.

3. The lower door edge seal of claim 2, wherein said securing plate extends slightly towards said interior plate so as to clamp said flexible seal means between said securing plate and said interior plate to frictionally retain said flexible seal means relative to said mounting means.

4. The lower door edge seal of claim 3, wherein said flexible seal means comprises an elongated flexible web having a transverse height dimension greater than a transverse height dimension of said interior plate so as to extend beneath said door when so installed, said elongated flexible web being of a longitudinal length greater than a longitudinal length of said securing plate so as to define a first lateral web projecting beyond a first lateral edge of said exterior plate, and a second lateral web projecting beyond a second lateral edge of said securing plate.

5. The lower door edge seal of claim 4, wherein said securing plate is shaped so as to define oppositely positioned beveled comers which permit a resilient flexing of said lateral webs relative to said mounting means without a piercingly engagement of said lateral webs with said securing plate.

6. A lower edge door seal comprising:

a flexible seal means for sealing both a space between a lower edge of a door and an underlying ground surface, and a space between a lateral edge of said door and adjacent lateral structure; and, a mounting means for securing said flexible seal means to a bottom lower edge of said door, said mounting means comprising an exterior plate having a plurality of mounting apertures extending therethrough and positionable against a lower exterior portion of said door; a lower edge plate having a plurality of mounting apertures extending therethrough and positionable into an abutting relationship with said bottom lower edge of said door and resiliently coupled at an exterior edge thereof to a lower edge of said exterior plate; an interior plate having a plurality of mounting apertures extending therethrough and positionable against a lower interior portion of said door and resiliently coupled at a lower edge thereof to an interior edge of said lower edge plate; a securing plate having a plurality of mounting apertures extending therethrough and coupled to an upper edge of said interior plate and extending substantially parallel to and coextensive with said interior plate, wherein said mounting means can receive said lower edge of said door between said exterior plate and said interior plate to position said lower edge plate into an abutting relationship with said bottom lower edge of said door, with said flexible seal means being received between said interior plate and said securing plate, said exterior plate projecting from said lower edge plate at an acute angle relative thereto, whereby said bottom lower edge of said door can be clamped and frictionally retained between said exterior plate and said interior plate of said mounting means, said securing plate extending slightly towards said interior plate so as to clamp said flexible seal means between said securing plate and said interior plate to frictionally retain said flexible seal means relative to said mounting means, wherein said flexible seal means comprises an elongated flexible web having a plurality of mounting apertures extending therethrough and having a transverse height dimension greater than a transverse height dimension of said interior plate so as to extend beneath said door when so installed, said elongated flexible web being of a longitudinal length greater than a longitudinal length of said securing plate so as to define a first lateral web projecting beyond a first lateral edge of said exterior plate, and a second lateral web projecting beyond a second lateral edge of said securing plate, with said security plate being shaped so as to define oppositely positioned beveled corners which permit a resilient flexing of said lateral webs relative to said mounting means without a piercingly engagement of said lateral webs with said securing plate.

7. The lower door edge seal of claim 6, and further comprising a plurality of threaded fasteners directed through said mounting apertures.

* * * * *